US005435292A

United States Patent [19]

Armstrong

[11] Patent Number: 5,435,292

[45] Date of Patent: Jul. 25, 1995

[54] COMPOUND BOW DRAW CHECK

[76] Inventor: Floyd W. Armstrong, R.R. #2, Sterling, Ontario, Canada, K0K 3E0

[21] Appl. No.: 172,044

[22] Filed: Dec. 22, 1993

[51] Int. Cl.[6] ..... F41B 5/14

[52] U.S. Cl. ..... 124/86; 124/25.6; 124/900

[58] Field of Search ..... 124/23.1, 24.1, 25.6, 124/86, 87, 88, 90, 900; 33/265

[56] References Cited

U.S. PATENT DOCUMENTS

| | | | |
|---|---|---|---|
| 3,097,624 | 7/1963 | Bergquist . | |
| 3,288,988 | 11/1966 | Boggs | 124/23.1 X |
| 3,450,122 | 7/1969 | Diamond . | |
| 3,499,414 | 3/1970 | Frydenlund . | |
| 3,518,959 | 7/1970 | Bunker . | |
| 3,669,059 | 6/1972 | Stuart . | |
| 3,867,920 | 2/1975 | Westphal . | |
| 4,061,107 | 12/1977 | Smith . | |
| 4,134,383 | 1/1979 | Flood . | |
| 4,179,613 | 12/1979 | Koren | 250/215 |
| 4,368,719 | 1/1983 | Christopher | 124/88 |
| 4,542,732 | 9/1985 | Troncoso . | |
| 4,572,153 | 2/1986 | MacPherson | 124/88 |
| 4,643,159 | 2/1987 | Ryan | 124/88 |
| 4,689,887 | 9/1987 | Colvin | 33/265 |
| 4,741,320 | 5/1988 | Wiard . | |
| 4,753,528 | 6/1988 | Hines et al. | 33/265 X |
| 4,813,150 | 3/1989 | Colvin | 33/265 |
| 5,060,626 | 10/1991 | Elliott et al. | 124/86 |

*Primary Examiner*—Eric K. Nicholson
*Assistant Examiner*—John A. Ricci
*Attorney, Agent, or Firm*—Andrus, Sceales, Starke & Sawall

[57] ABSTRACT

A compound bow drawcheck is disclosed for a compound bow which has a bow string connected to a bow cable and a rotatable cable guide over which the bow cable is guided, whereby the cable guide rotates in a predetermined relationship with the bow cable when the bowstring is drawn and between a first position wherein the bow string is not drawn and a second position wherein the bow string is at a desired drawl. The draw check includes a detector which detects when the cable guide is in the second position and an indicator which produces a signal when the second position is detected. The detector is either an electrical switch operated by mechanical interaction between a contact strip on the cable guide and electrical contacts on the bow limb carrying the cable guide, an optical sensor detecting a mark on or a hole in the cable guide or a sensor detecting a magnetic strip on the guide. The indicator includes a signal light or LED or a buzzer. The draw check is more accurate than prior art devices and detects underdraw as well as overdraw.

5 Claims, 7 Drawing Sheets

COMPOUND BOW DRAW CHECK

FIELD OF THE INVENTION

The present invention relates to archery equipment and more particularly to compound bows and draw indicators used for improving the accuracy of the bow and archer by improving the repeatability of the draw.

BACKGROUND OF THE INVENTION

Archery is a sport which, especially when pursued competitively, demands high accuracy. Sophisticated compound bows have been developed for the shooting of an arrow toward a target. However, one particular reoccurring problem that is generally encountered by archers in accurately aiming an arrow is the difficulty to determine reliably when the arrow has been drawn back on the bow string to the most desirable position providing the proper tension in the bow string for an accurate firing of the arrow. An arrow's trajectory is determined by the initial velocity and angle of firing. The initial velocity is directly dependent on the accelerating force exerted on the arrow by the bow string when both are released. The accelerating force in turn depends on how far the bow string has been drawn back from the center of the bow. A skilled archer will use a bow which he is able to draw completely, since the greater the draw, the larger the accelerating force and the straighter the arrow's trajectory will be. However, unless the bow is drawn to the same extent on every shot, the individual arrow trajectories will be different resulting in a low shooting accuracy.

Most archers use draw checks, usually of the audible clicker type, to indicate when they have reached full bow string draw which enables them to have the bow string apply the same propelling force to the arrow each time, thereby improving their shooting accuracy. U.S. Pat. Nos. 3,499,414 to Frydenlund; 3,518,959 to Bunker; 3,669,059 to Stuart and 4,061,107 to Smith are examples of known devices which produce an audible signal when the arrow head or point reaches the arrow guide or rest and the bow string has been retracted a uniform distance for each arrow and is ready for release. However, most of these clicker devices include mounts or brackets which extend into the flight path of the stabilizing feathers or vanes or other portions of the arrow and, thus, affect shooting accuracy. Furthermore, none of these clicker devices will warn the archer of overdraw which is a common reason for shooting inaccuracy and occurs when after the audible signal has been released the arrow is drawn back further than the desired draw.

Other arrow actuated devices designed to signal full draw are described in U.S. Pat. No. 3,450,122 by Diamond which discloses a signal light actuated by closing an electric circuit through magnetic material incorporated into special arrows; U.S. Pat. No. 3,867,920 by Westphal wherein the electric signal light circuit is closed through an electric conductor close to the arrow's tip; and U.S. Pat. No. 4,179,613 by Koren which discloses a photoelectric sensor for detecting the tip of the arrow at full draw. However, all of these devices require the use of special arrows or arrows of constant length, cannot be used with some large arrow tips such as hunting type broadheads, and cannot detect overdraw.

Draw indicators which operate independently of the type of arrow used are disclosed by Bergquist in U.S. Pat. No. 3,097,624 wherein the bending of the bow structure itself is used to operate a cricket snapper device; by Flood in U.S. Pat. No. 4,134,383 who teaches the closing of a signal light circuit by a switch that is operated by a cord connected to the bow string; by Christopher in U.S. Pat. No. 4,368,719 disclosing a cable guard mounted clicker device actuated by the rearward moving bow cables upon bending of the bow; by Troncoso in U.S. Pat. No. 4,542,732 and Wiard in U.S. Pat. No. 4,741,320 who teach cable guard mounted electric signal light actuating switches which are operated by a bow cable mounted contact block; and by MacPherson in U.S. Pat. No. 4,572,153 who teaches the use of an electric signal light actuating switch mounted in and protruding from a hollow cable guard, whereby the switch is operated by a bow cable passing thereover during bending of the bow. Of all the devices disclosed in these patents, only two indicate overdraw, namely the Flood and MacPherson devices. However, both these indicators are rather crude since they are operated by the movement of the bow cables in relation to the bow upon bending of the bow which movement is small compared to the corresponding difference in draw of the bow string. Furthermore, the indicators are operated by mechanical interaction between the movable bow string or bow cables and a stationary structure of the bow, which may affect accuracy. Thus, a more accurate draw check is desired which indicates both under and over draw and preferably does not operate on the basis of a mechanical interaction between the indicator and movable parts of the bow.

SUMMARY OF THE INVENTION

It is now an object of the present invention to provide a compound bow draw check which more accurately indicates when the bow string is fully drawn.

It is another object to provide a draw check which not only indicates full draw, but also overdraw.

These objects are achieved with a draw check in accordance with the invention which is associated with one or both of the cable guide pulleys or cams of a compound bow.

Accordingly, the invention provides a draw check for a compound bow having a bow string connected to a bow cable and a rotatable cable guide over which the bow cable is guided, whereby the cable guide rotates in a predetermined relationship with the bow cable when the bow string is drawn and between a first position wherein the bow string is not drawn and a second position wherein the bow string is at a desired draw. The draw check includes a detector for detecting when the cable guide is in the second position; and an indicator connected to the detector for producing a signal when the second position is detected by the detector.

Since even small displacements of the bow string always directly translate into a rotational movement of the cable guide pulley, this draw check is more sensitive than devices relying on the displacement of bow cables along a cable guard, since per given bow string draw, the movement of the cables relative to the guard is much less than the movement of the cable guide pulley relative to the associated bow limb.

In a preferred embodiment of the draw check in accordance with the invention, the detector includes a pair of contact points mountable to a limb of the bow in spaced apart relationship and opposite to the rotatable cable guide, and a contact strip attachable to the rotatable cable guide, the size and position of the contact strip being selected such that the contact strip electrically connects the contact points only when the rotatable cable guide is in the second position.

Either one or both of the detector and the indicator of the draw check can be completely integrated into a compound bow during manufacture thereof or added onto existing bow constructions.

The pair of contact points are preferably a pair of sliding contacts engaging a radially extending surface of the rotatable cable guide and the contact strip is preferably an elongated strip of electrically conductive foil which is attached to the surface of the rotatable cable guide engaged by the sliding contacts. The contact strip preferably extends in circumferential direction of the cable guide when the contacts are also spaced in that direction, whereby the length of the contact strip corresponds to the smallest distance between the contact surfaces of the contacts in circumferential direction of the cable guide.

The sliding contacts can also be spaced apart in radial direction of the cable guide when the contact strip is oriented in radial direction of the cable guide, whereby the width of the contact strip is sufficiently small so that the contacts are electrically connected by the contact strip only when the cable guide is in the second position.

Although one preferred embodiment of the draw check as described above is of the mechanical contact type for reasons of simplicity and economy, in another preferred embodiment the detector is constructed to have absolutely no mechanical interaction with the cable guide pulley. In such an embodiment, the detector includes means for providing an optical density gradient on the cable guide and an optical sensor for detecting the density gradient when the cable guide is in the second position. The size and position of the optical density gradient is preferably selected such that it is detected only when the rotatable cable guide is in the second position. The optical density can be achieved by a removably attachable band which is either reflective or of different colour than that surface of the cable guide to which it is attachable or is an opening provided in the cable guide.

BRIEF DESCRIPTION OF THE DRAWINGS

Preferred draw checks in accordance with the invention will now be further described by way of example only and with reference to the following drawings, wherein FIGS. 1 and 2 respectively illustrate a side and a rear elevation of a compound bow including one preferred draw check in accordance with the invention.

DETAILED DESCRIPTION OF THE INVENTION

Figure 1:
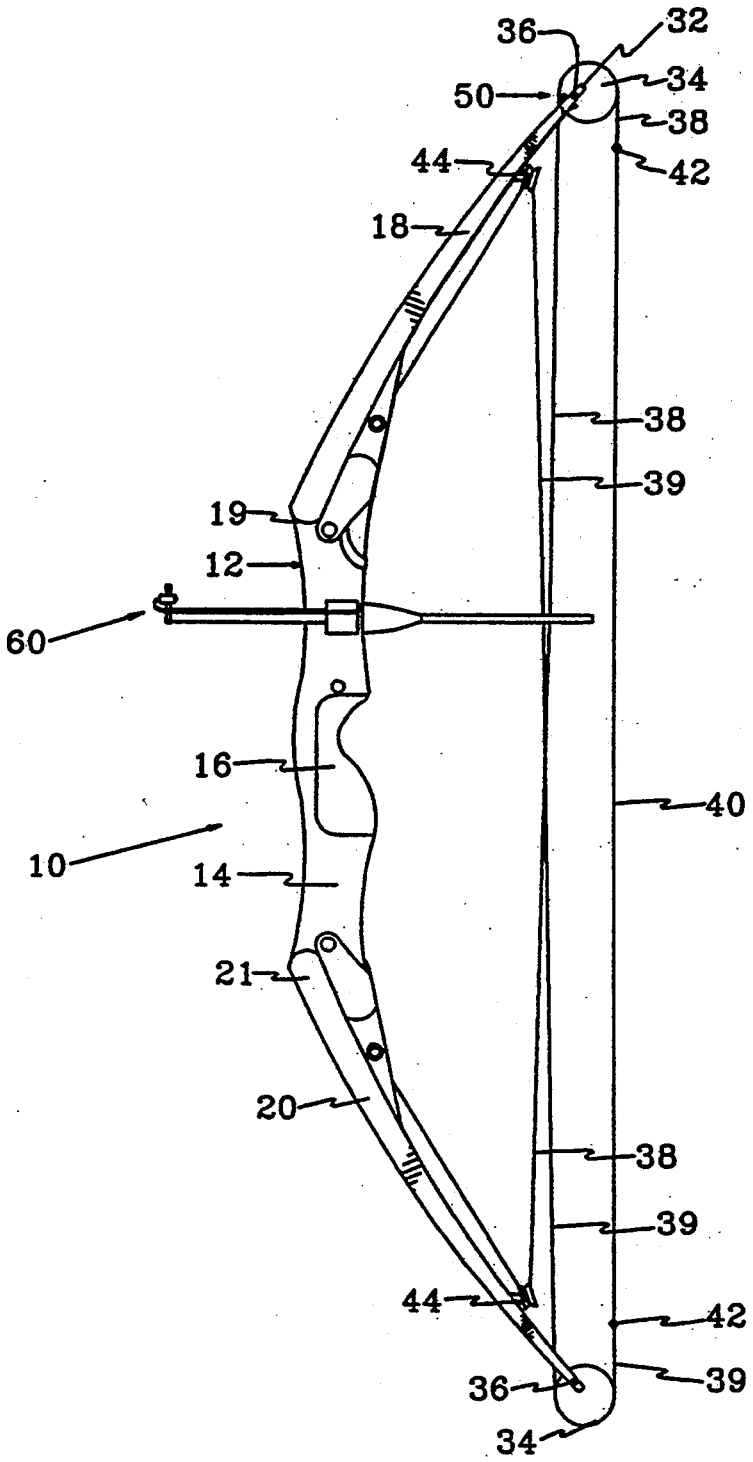
Figure 2:
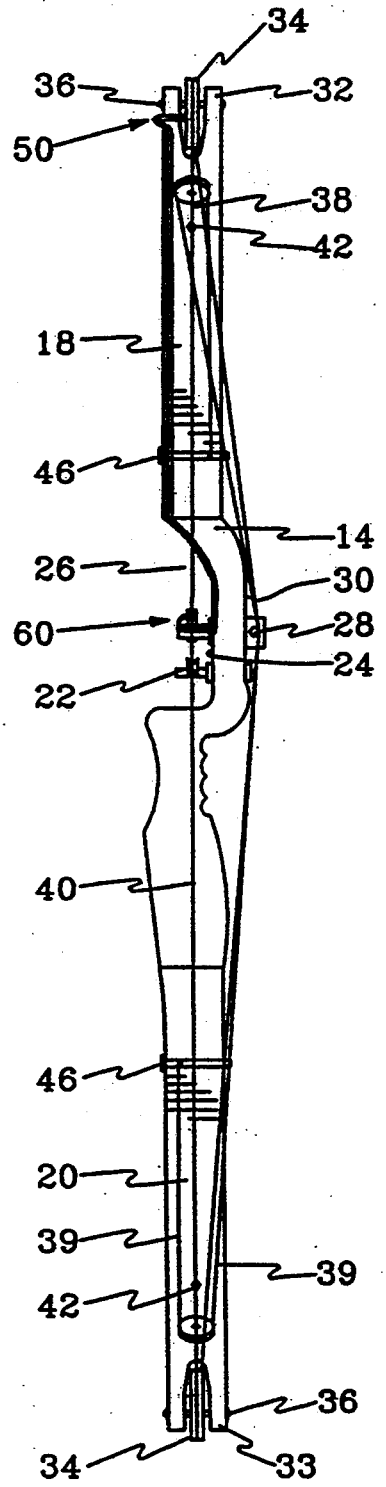

One preferred draw check in accordance with the invention is mounted to a conventional compound bow 10 as shown in FIGS. 1 and 2 which bow generally includes a body 12 consisting of a wood or metal riser 14 having a handle portion 16 and upper and lower laminated, composite bow limbs 18, 20 respectively affixed to upper and lower ends 19, 21 of the riser. The preferred draw check includes a detector or switch portion 50 attached to the upper bow limb 18 and an indicator portion 60 mounted to the riser 14. Bow limbs 18, 20 at their respectively forked ends 32, 33 each carry a cable guide pulley 34 which is rotatably mounted on an eccentrical axle 36 that extends transverse to the respectively associated limb. Bow cables 38, 39 are attached by conventional string connectors 42 at one end to a bow string 40 for the engagement of an arrow (not shown). Each cable is guided over one of the cable guide pulleys and around a redirecting stud 44 and is at the other end attached to an adjustment bolt 46. An arrow rest 22 is mounted to that side wall 24 of the riser 14 which delimits an aiming window 26 of the bow 10. A cable guard 28 is mounted to the opposite side wall 30 of the riser 14 to prevent the cables 38, 39 extending across the aiming window 26, thereby providing proper arrow vane clearance.

Figure 3:
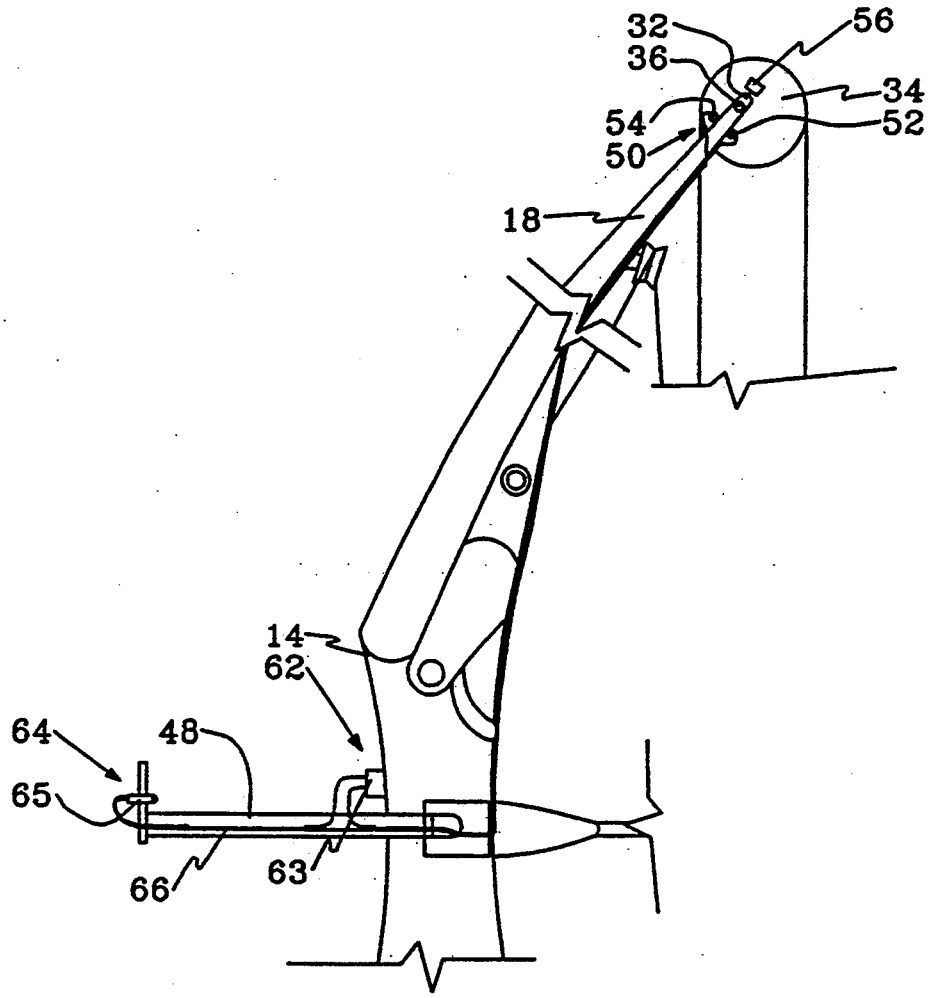
FIG. 3 is an enlargement of the upper half of the compound bow-draw check combination shown in FIG. 1.

Turning now to FIG. 3, the indicator portion 60 of the draw check includes a power source 62, in this embodiment a 3 to 6 volt standard dry cell battery of the type used in hearing aids, attached to the riser 14, a signal generator 64 in the form of a signal light 65 (bulb or light emitting diode (LED)) attached to the bow sight 48, and electrical conductors 66 (flexible low voltage wires) which connect one pole of the battery 63 directly with the signal light 65 and the other pole of the battery also with the signal light but through the detector portion 50. The detector portion 50 interrupts the latter connection when the bow string is not in a selected draw position as will be described further below. Thus, electrical power is supplied from the battery 63 to the signal light 65 only when the bow string is in the selected draw position.

The detector portion 50 includes a pair of spaced apart spring loaded sliding contact pins 52, 54 which are respectively attached to front and back surfaces of the forked end 32 of the upper bow limb 80 and opposite a radially extending surface of the pulley 34 mounted in the limb (see also FIG. 2). Further included in the detecting portion 50 is a contact strip 56 made of a copper foil which is attached to the pulley 34 with an adhesive or two sided adhesive tape that permits removal and replacement of the strip. The position of the strip and its length are selected such that the strip electrically connects the contacts only when the bow string is fully drawn which will be more easily understood with reference to FIG. 4.

Figure 4:
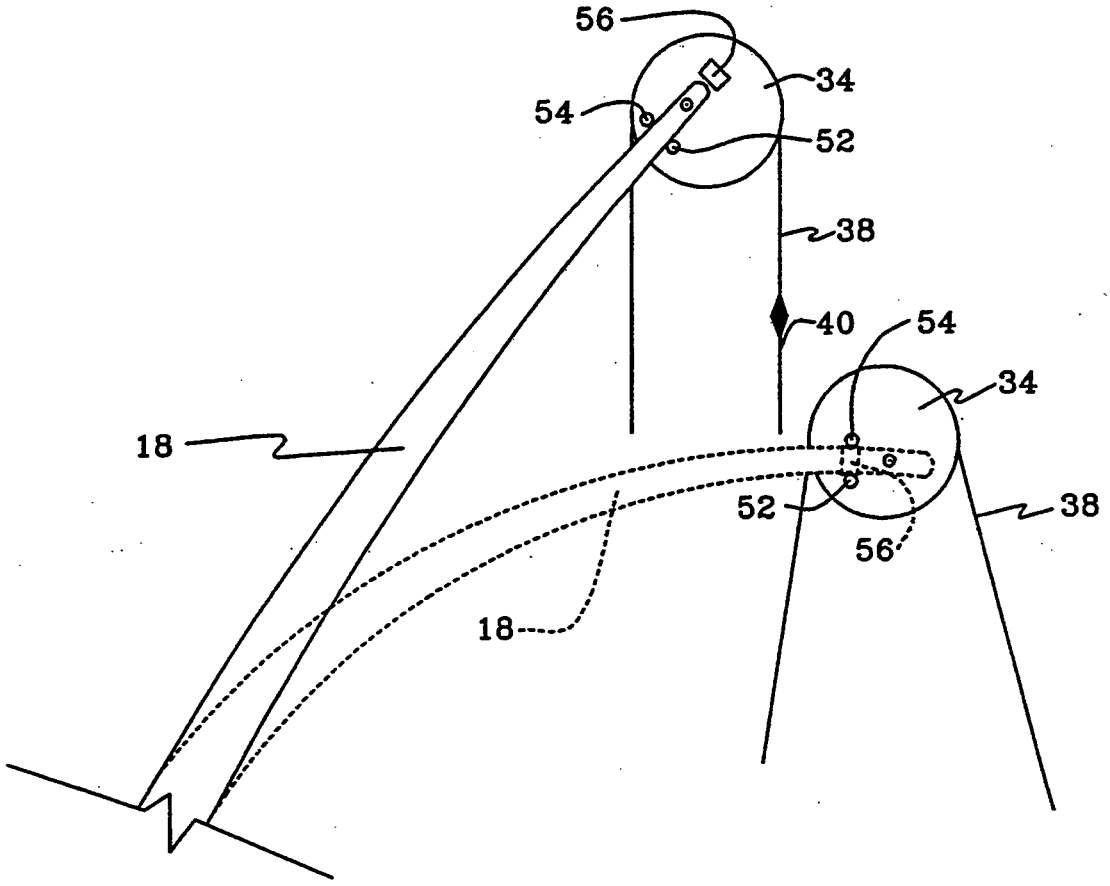
FIG. 4 is a schematic illustration of the construction and function of the detector portion of the preferred draw check shown in FIG. 1.

FIG. 4 schematically illustrates the upper limb 18 which is moved upon drawing of the bow string 40 from an at rest position (continuous lines) wherein the bow string is not drawn to a draw position (broken lines) wherein the bow is fully drawn as desired for optimum firing of an arrow (not shown). Since the bow cable 38 is tensioned around the pulley 34 and directly connected to the bow string 40, the pulley is correspondingly rotated in clockwise direction between a first position shown in the upper half of FIG. 4 and a second position shown in the lower half. The contact strip 56 is of rectangular shape and its long sides substantially extend in circumferential direction of the pulley 34. The strip 56 is positioned on the pulley 34 in such a way that it is moved towards the contacts 52, 54 by the clockwise rotation of the pulley from the first to the second position upon drawing of the bow. When the desired draw of the bow string is reached and the pulley is in the second position the contacts are electrically connected by the strip 56 thereby closing the electric circuit of the draw check which results in illumination of the signal light 65. The overall length of the contact strip, in this embodiment 11/16 inch, corresponds to the smallest distance between the contact surfaces of the sliding contact pins 52, 54 so that the contacts are electrically connected only in one rotational position of the pulley 34, the second position which corresponds to the desired draw of the bow string.

Figure 5:
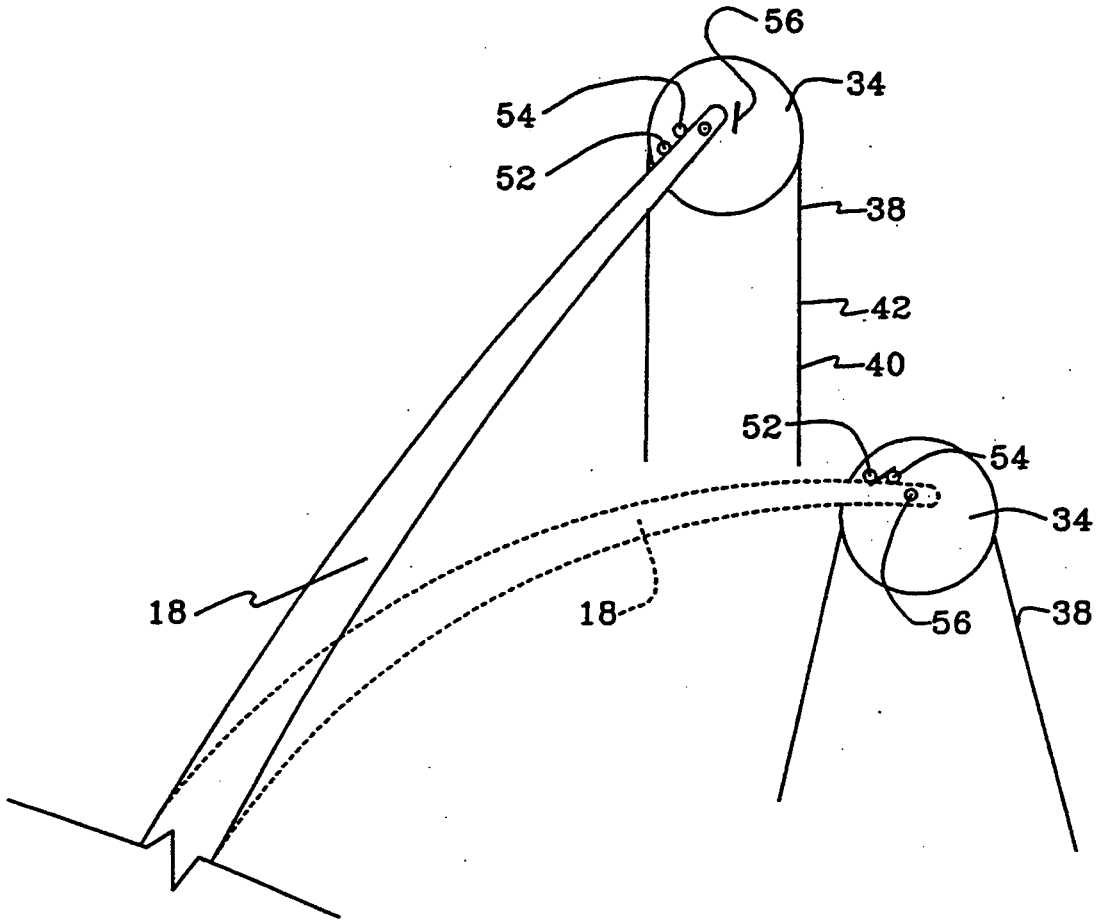
FIG. 5 is a schematic illustration of the construction and function of a variant of the detector portion of the preferred draw check shown in FIG. 1.

As illustrated in FIG. 5, which shows a variant of the detector portion 50, the contacts can also be connected both to the same front or back surface of the upper of lower limb end 32 and spaced apart in radial direction of the pulley when the rectangular contact strip 56 is oriented substantially in radial direction of the pulley 34. In this variant of the draw check in accordance with the invention, the length of the strip is the same as or longer than the distance between the contacts 52, 54, in this embodiment ¾ inch. However, the orientation of the strip is such that when the bow is in the desired draw position, the strip extends at an angle to a line connecting the contacts, whereby the strip only contacts the edge of the respective contact surfaces of the contacts. As a result, the signal light 65 (see FIG. 3) is activated only when the pulley 34 is in the second position as shown in the lower half of FIG. 5 and the bow string 40 is at the desired draw.

Figure 6:
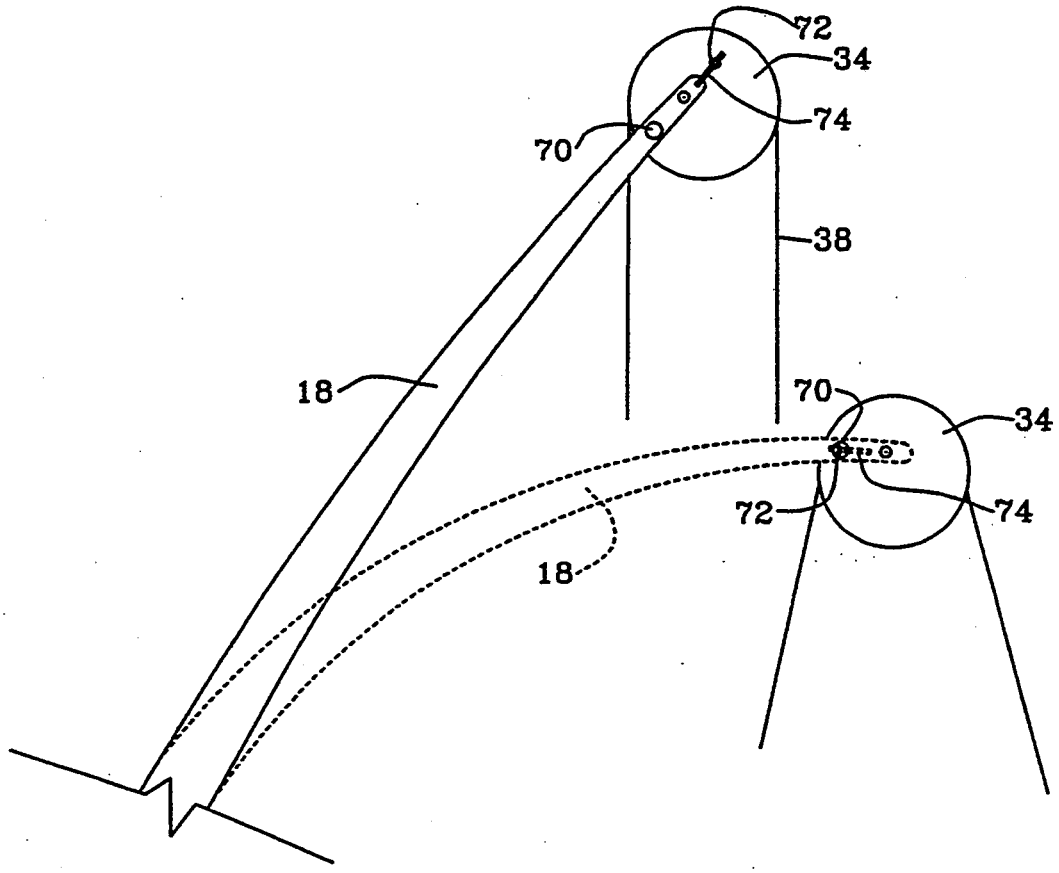
FIG. 6 is a schematic illustration of the construction and function of the detector portion of a draw check in accordance with the invention operating without mechanical interaction with moving parts of the bow and including an optical sensor.
Figure 7:
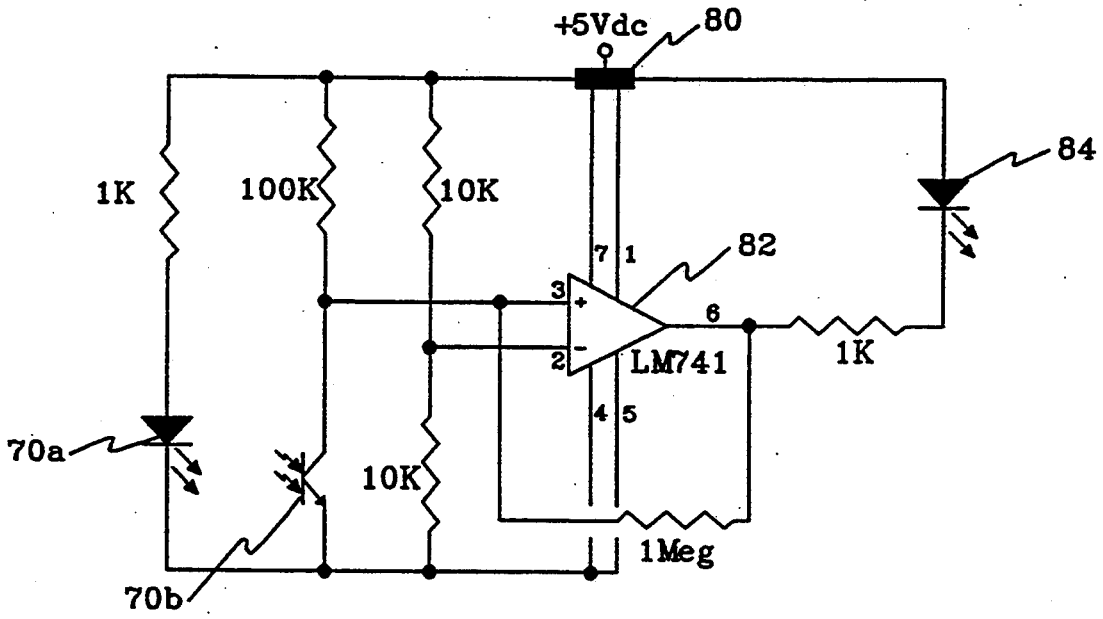
FIG. 7 is a circuit diagram of an optical draw check in accordance with the invention which can be added onto existing compound bows.

FIG. 6, illustrates another preferred detector 50 which operates without mechanical interaction with any relatively movable parts of the bow. The detector 50 includes an optical sensor 70 (DIALIGHT CO.) and a mark or hole 72 which is provided on or in the pulley 34 to create an optical density gradient which is detectable by the optical sensor. The position and size of the mark or hole is such that it is only detected when the pulley 34 is in the second position. The mark is a coloured or reflective band 74 generally available from vendors or suppliers of optical sensors, in this embodiment a white strip adhesively affixed to a black pulley. The width of the band 74 is sufficiently small so that the optical sensor 70 is triggered only when the pulley is in the second position and in this embodiment corresponds to the minimum strip width detectable by the sensor. Although this embodiment of the detector portion 50 works reliably, other optical sensors may not be appropriate for reliable detection of a coloured or reflective band, and for those it is preferred to use a hole in the pulley the size and position of which is selected so that the optical sensor is only triggered when the pulley is in the second position. When the sensor 70 is triggered, the signal light 65 (see FIG. 3) is supplied with battery power through an appropriate electronic switch (see FIG. 7). Thus, when the bowstring 40 is not yet at the desired draw position (underdraw), the signal light 65 is not illuminated and upon further tensioning of the bowstring, the signal light will illuminate once the desired bow string draw is reached and go off when the bow string is tensioned beyond the desired draw (over draw). The detector portion 50 can be adjusted to different draw lengths by repositioning of the band 74 in circumferential direction of the pulley 34.

Compound bows used during hunting are often exposed to adverse weather conditions (rain, snow) and dirt, all of which may interfere with the operation of an optical sensor as described above. For hunting type applications, another preferred embodiment of the detector has been developed which includes a hall effect sensor (Hall Effect Micro Switch, Div. of Honeywell Mfg.) instead of the optical sensor 70 and an elongated stick magnet or magnetic strip in place of the band 74. The magnetic strip is placed on the pulley 34 such that it passes the hall effect sensor when the bow string is moved from underdraw to over draw and is detected by the sensor when the bow string is at the desired draw. This type of detector is unaffected by rain, snow, dirt and many other contaminants.

The preferred circuitry for the optical detector described above is illustrated in FIG. 7. The sensor **70*a* includes a source of optical radiation, an infrared light emitting diode 70*a*, and an optical radiation detector, a phototransistor 70*b* triggered by infrared light. Operating power is continuously supplied from a 5 V battery 80 to the diode 70*a* and to an operation amplifier 82 (LM741). One pole of a visible light emitting diode (LED) 84 is connected to the positive pole of the battery 80 and the other pole to pin 6 of the operational amplifier 82. When infrared light emitted by the diode 70*a* is reflected by a band 74 (see FIG. 6) onto the photo transistor 70*b*, the latter becomes conductive which produces a voltage drop at pin 3 of the amplifier 82 which in turn results in pin 6 becoming sufficiently more negative than pin 3 to cause a flow of current through the LED 84 which illuminates it. Thus, this circuit is configured to operate upon the reflection of infrared light onto the phototransistor 70*b*, but persons of skill in the art will readily appreciate that the circuit can be reconfigured to operate upon interruption of infrared light directed onto the phototransistor. Furthermore, this circuit may also be used in combination with a hall effect sensor replacing the phototransistor. In that configuration the diode 70*a*** is also omitted and, thus, the power consumption of the circuit is reduced and battery life increased.

Persons of skill in the art will further understand that other types of batteries than those mentioned above may be used in connection with any of the mechanical, optical or magnetic detectors of the invention. Furthermore, contacts other than the spring loaded contact pins may be used in the mechanical detectors shown in FIGS. 3–5, for example self-cleaning leaf spring sliding contacts. Also, although the above described embodiments of draw checks in accordance with the invention included indicators which produce a visible signal for reasons of lower power consumption, acoustic signal producing indicators may also be used which include, for example, an electric buzzer or a mechanical clicker. Finally, but most importantly, draw checks in accordance with the invention may include two detector/indicator combinations for separately detecting and indicating the desired draw and over draw, for example with differently coloured signal lights.

Changes and modifications in the specifically described embodiments can be carried out without departing from the scope of the invention which is intended to be limited only by the scope of the appended claims.

I claim:

1. A draw check for a compound bow having a bow string connected to a bow cable and a rotatable cable guide over which the bow cable is guided, the cable guide rotating in a predetermined relationship with the cable when the bow string is drawn and between a first position wherein the bow string is not drawn and a second position wherein the bow string is at a desired draw, comprising:

a detector for detecting when the cable guide is in the second position, the detector including means for creating an optical density gradient on the cable guide and an optical switch having an optical sensor for detecting the optical density gradient when the cable guide is in the second position; and an indicator connected to the detector for producing a signal when the second position is detected by the detector.

2. A draw check as defined in claim 1, wherein the optical switch is mountable on a limb of the bow and opposite a radially extending surface of the cable guide, and the optical density gradient is achieved with one of a radially extending coloured band, and a reflective band respectively attachable to the radially extending surface, and an opening in the radially extending surface.

3. A draw check as defined in claim 2, wherein the indicator includes an electrical power source electrically connected to the optical switch, a signal generator and electrical conductors for electrically connecting the optical switch to the signal generator, the optical switch providing power from the power source to the signal generator only when the optical density gradient is detected by the optical sensor.

4. A draw check as defined in claim 3, wherein the power source is a battery and the signal generator is one of a signal light and a light emitting diode (LED).

5. A draw check as defined in claim 1, wherein the detector and the indicator are integrated components of the bow.

* * * * *